US012152206B2

(12) United States Patent
Saxena et al.

(10) Patent No.: US 12,152,206 B2
(45) Date of Patent: Nov. 26, 2024

(54) DEBOTTLENECK SOLUTION FOR DELAYED COKER UNIT

(71) Applicant: KELLOGG BROWN & ROOT LLC, Houston, TX (US)

(72) Inventors: Samir Saxena, Delhi (IN); Yellaiahnaidu Mekala, Delhi (IN)

(73) Assignee: Kellogg Brown & Root LLC, Houston, TX (US)

( * ) Notice: Subject to any disclaimer, the term of this patent is extended or adjusted under 35 U.S.C. 154(b) by 181 days.

(21) Appl. No.: 17/792,389

(22) PCT Filed: Jan. 13, 2020

(86) PCT No.: PCT/US2020/013354
§ 371 (c)(1),
(2) Date: Jul. 12, 2022

(87) PCT Pub. No.: WO2021/145853
PCT Pub. Date: Jul. 22, 2021

(65) Prior Publication Data
US 2023/0220285 A1 Jul. 13, 2023

(51) Int. Cl.
*C10G 9/00* (2006.01)
*C10B 55/00* (2006.01)
(Continued)

(52) U.S. Cl.
CPC ..... *C10G 9/005* (2013.01); *C10B 55/00* (2013.01); *C10B 57/045* (2013.01); *C10G 7/00* (2013.01);
(Continued)

(58) Field of Classification Search
CPC ..... C10G 21/003; C10G 55/04; C10G 9/005; C10G 67/0454; C10G 2300/1077; C10G 2300/44
See application file for complete search history.

(56) References Cited

U.S. PATENT DOCUMENTS 4,130,475 A * 12/1978 Cameron ..... C10B 57/045 208/54
9,994,780 B2 6/2018 Koseoglu
(Continued)

OTHER PUBLICATIONS

Vacuum Distillation Unit, EnggCyclopedia, Apr. 1, 2018 [retrieved on Mar. 4, 2020]. Retrieved from the Internet: <URL: https://web.archive.org/web/20180401103104/https://www.enggcyclopedia.com/2021/01/vacuum-distillation-unit/>. entire document.
(Continued)

*Primary Examiner* — Randy Boyer
*Assistant Examiner* — Juan C Valencia
(74) *Attorney, Agent, or Firm* — Gary Machetta

(57) ABSTRACT

The present invention relates to debottleneck solution for delayed Coker unit. More particularly, this invention relates to bottoms of vacuum residuum routed to Coker unit through de-asphalting unit to avoid revamp of existing Coker for the processing of heavier feed stock when there is a change in crude slate. Another object of the invention, in particular, relates to improved delayed coking products, a process used in petroleum refineries to crack petroleum residue, thus converting it into gaseous and liquid product streams and leaving behind solid, carbonaceous petroleum coke.

5 Claims, 6 Drawing Sheets

(51) Int. Cl.

| | |
|---|---|
| ***C10B 57/04*** | (2006.01) |
| ***C10G 7/00*** | (2006.01) |
| ***C10G 21/00*** | (2006.01) |
| ***C10G 55/04*** | (2006.01) |

(52) U.S. Cl.
CPC ..... *C10G 21/003* (2013.01); *C10G 55/04* (2013.01); *C10G 2300/1077* (2013.01); *C10G 2300/4056* (2013.01); *C10G 2400/06* (2013.01); *C10G 2400/08* (2013.01); *C10G 2400/26* (2013.01)

(56) References Cited

U.S. PATENT DOCUMENTS

| | | | | |
|---|---|---|---|---|
| 2017/0306240 | A1* | 10/2017 | Koseoglu | C10B 55/00 |
| 2017/0335199 | A1* | 11/2017 | Iqbal | C10B 57/045 |
| 2019/0055481 | A1* | 2/2019 | Pradeep | C10B 55/00 |

OTHER PUBLICATIONS

International Search Report and Written Opinion dated Mar. 20, 2020 for International Application No. PCT/US2020/013354 filed on Jan. 13, 2020; 20 pages.

* cited by examiner

FIG. 1 OPERATION OF EXISTING COKER UNIT

FIG. 2 OPERATION OF EXISTING COKER FOR NEW FEED RATE AND CCR

FIG. 3 PRESENT PROCESS SCHEME USING ROSE® TECHNOLOGY

DEBOTTLENECK SOLUTION FOR DELAYED COKER UNIT

CROSS-REFERENCE TO RELATED APPLICATIONS

This application is the National Stage of International Application No. PCT/US2020/013354, filed Jan. 13, 2020.

TECHNICAL FIELD

The present invention relates to debottleneck solution for delayed Coker unit. More particularly, this invention relates to bottoms of vacuum residuum routed to Coker unit through de-asphalting unit to avoid revamp of existing Coker for the processing of heavier feed stock when there is a change in crude slate.

BACKGROUND OF THE INVENTION

Many of the refiners around the world are augmenting the existing capacities to meet their product demand and improve the profitability. Some refiners are inclined to change the crude slate from lighter crudes to heavy crudes due to availability and price. Augmenting the refinery capacity and/or crude slate change requires modifications to the existing units in the refinery. One of the refinery units which require an expensive revamp for these changes is the Delayed Coker Unit (DCU) which is commonly known as Coker. Otherwise there is a need to treat the heavy residuum i.e. by removing asphalts and heavy metals.

Solvent de-asphalting (SDA) is a process that separates heavy hydrocarbon oil into two phases, an asphalt phase, which contains substances of relatively low hydrogen to carbon ratio often called asphaltene type materials and a de-asphalted oil phase, which contains paraffinic type material substances of relatively high hydrogen to carbon ratio often called De-asphalted Oil (DAO). The ability of the solvent to distinguish between high carbon to hydrogen asphaltene type and low carbon to hydrogen paraffinic type materials is termed as selectivity.

Solvent de-asphalting of heavy residual hydrocarbon oils using solvents to remove contaminants such as asphaltenes, metals and sulphur constituents has long been a standard processing practice in the petroleum refining industry. In the era of high crude oil prices, refiners prefer to process cheaper heavier crude. The residue generated from heavy crude can be upgraded through solvent de-asphalting process to produce DAO for secondary processes.

Solvent de-asphalting of residue is primarily being employed for (lube-oil base stocks) LOBS production. However, the process also employed to produce more feedstock for secondary conversion processes such as Fluid Catalytic Cracking (FCC) and hydrocracking so as to upgrade bottom of the barrel and improve distillate yield. Conventionally, Propane de-asphalting is predominantly used for production of LOBS feedstock and slightly heavier paraffinic solvents are used for production of feedstock for conversion process. Propane de-asphalting produces high quality DAO suitable for LOBS production with limited DAO yield while use of heavier solvent say, C5 hydrocarbons results in increased DAO yield at the cost of quality. Thus, the choice of solvent for de-asphalting is made based on the requirement of DAO yield and rejection level of contaminants leading to requirement of two different processing units.

The use of light hydrocarbon to upgrade heavy hydrocarbon oils is the subject of many patents, for instance U.S. Pat. Nos. 4,502,944, 4,747,936, 4,191,639, 3,975,396, 3,627,675, and 2,729,589. Use of mixture of propane, CO2, H2S is reported in U.S. Pat. No. 4,191,639 and an increase in DAO yield for same quality is also reported.

Delayed coking is a process used in petroleum refineries to crack petroleum residue, thus converting it into gaseous and liquid product streams and leaving behind solid, carbonaceous petroleum coke. The excess generation of low value petroleum coke in Delayed coking unit causes problems of coke handling and also reduces the profitability. In order to improve the conversion of the heavy residue feedstock, different process configurations employing combination of delayed coking and solvent de-asphalting processes have been employed in the prior art.

U.S. Pat. No. 3,617,481 discloses a combination of De-asphalting-Coking-Hydrotreating processes. The residue feed is first de-asphalted in a de-asphalting extractor and then the asphalt pitch is coked to obtain residual coke, by directly routing to the coking reactor. The metal containing coke is gasified in a gasifier in presence of steam and the said activated coke is employed for hydrotreating.

U.S. Pat. No. 6,673,234 describes a combination of low degree solvent asphalting and delayed coking process. In the first step, a low degree solvent de-asphalting is employed to remove the heavy asphaltene portion of the residue feedstock, in which the yield of de-asphalted oil ranges from 70 to 95 wt % of residue feedstock. In the second step, the de-asphalted oil containing lesser asphaltenes compared to the residue feedstock, along with an optional residue feed, is fed to the delayed coking section of the process. The main objective of the process is to produce premium quality petroleum coke from the residue feedstock.

U.S. Pat. No. 9,296,959 describes the integration of solvent de-asphalting with resid hydroprocessing and delayed coking. First step of this process consist of solvent de-asphalting of residue feedstock to obtain three fractions namely, de-asphalted oil, resin and pitch. The resin steam is subjected to hydrotreating, in which lighter hydrocarbons are generated and recovered. The hydrotreated resin and pitch combine together and is sent to the delayed coking section. In an embodiment, the hydrotreated resin stream is further subjected to solvent extraction to recover lighter material, before being sent to the delayed coking section.

U.S. Pat. Application No. 2017/0029720 describes an enhanced solvent de-asphalting delayed coking integrated process, where the de-asphalted oil is routed to the delayed Coker unit for coking. In an embodiment, the solvent de-asphalting is carried out in presence of an adsorbent material for removal of poly nuclear aromatics, sulfur and nitrogen compounds.

It is seen that different schemes have been described in the art wherein a combination of solvent de-asphalting and delayed coking processes. But, none of the schemes, teach how to maintain the Coker unit feed limit with change in crude slate without impact to other units. In the case where pitch after de-asphalting of vacuum residue is routed directly to delayed Coker fractionator bottom, the recycle fraction will mix with the pitch. This pitch with recycle fraction when subjected to delayed coking in coke drums, product yield pattern deteriorates in terms of higher coke yield. In case where the fractionator is made to operate at zero recycle, where condensation of heavy material from product vapors entering the Coker unit is avoided, the quality of heavier products like Heavy Coker Gas Oil (HCGO) and Coker Fuel Oil (CFO) deteriorates in terms of increasing density, CCR and asphaltene content, impacting the downstream unit operations like hydrocracker. In view of this it is beneficial to have a process scheme in which the quality of HCGO and CFO is not compromised while change in crude slate.

OBJECTIVE OF THE INVENTION

The main object of the present invention is to provide an improved functioning of Delayed Coker Unit (DCU) to avoid the revamp of existing Coker Unit when the change in crude slate(s).

Another object of the invention, in particular, relates to improved delayed coking products, a process used in petroleum refineries to crack petroleum residue, thus converting it into gaseous and liquid product streams and leaving behind solid, carbonaceous petroleum coke.

Still another object of the invention is to provide a solvent de-asphalting process, in which the residue feedstock such as reduced crude oil or vacuum residue is mixed with lighter solvents to remove the asphaltene rich phase from the feedstock, which helps in providing rich products from delayed Coker unit.

SUMMARY OF THE INVENTION

This summary is provided to introduce a selection of concepts in a simplified format that are further described in the detailed description of the invention. This summary is not intended to identify key or essential inventive concepts of the claimed subject matter, nor is it intended for determining the scope of the claimed subject matter.

This invention relates to improve the functioning of Delayed Coker Unit (DCU) and also avoid the revamp of existing Coker Unit by Residuum Oil Supercritical Extraction (ROSE®) process commonly known as Solvent Deasphalting (SDA) technology.

Vacuum Residue (VR) or a portion of it routed to DCU through ROSE unit. This provide maintaining the feed within the limits of an existing feed to Delayed Coker unit. Therefore there is no impact on design of existing DCU such that it doesn't require any revamp of the existing process. Accordingly, the process of present invention results in reduced investment to achieve the same objectives.

The pitch produced from ROSE unit can be solidified in the form of flakes (solid fuel) in KBR licensed solidification process (AiMS). The flakes thus produced has similar properties as Petcoke and it is used as substitute of Petcoke in CFBC boiler and in Cement industry.

The present process and its products provides an economic benefit comparing with VR bottoms with high contaminants direct routed to Coker unit.

BRIEF DESCRIPTION OF THE DRAWINGS

The aforementioned aspects and other features of the present invention will be explained in the following description, taken in conjunction with the accompanying drawings, wherein:

FIG. 1 of the present invention represents the operations of existing Coker unit, where the VR bottoms receiving as a feed for Coker unit, wherein the drawbacks as mentioned the performance of the Coker unit is not up to the mark when there is change in crude slate.

FIG. 2 of the present invention represent the operation of existing Coker unit for new feed rate and CCR, In this case Coker requires revamp to manage the new operating scenario.

FIG. 3 of the present invention describes the new process scheme VR bottoms routed to Coker unit through de-asphalting unit, as de-bottleneck solution which eliminates the need of Coker revamp.

EQUIPMENT DESCRIPTION

101: Vacuum Distillation Column
102: Coker Fractionator
103: Coker Furnace
104/105: Coke Drum
201: Vacuum Distillation Column
202: Coker Fractionator
203: Coker Furnace
204/205: Coker Drum
301: Vacuum Distillation Column
302: Coker Fractionator
303: Coker Furnace
304/305: Coke Drum
306: Asphaltene Separator
307: DAO Separator
308: DAO Stripper
309: Asphaltene Stripper
310: Solvent Surge Drum
311: KBR Licensed Solidification Process

DETAILED DESCRIPTION

It should be understood at the outset that although illustrative implementations of the embodiments of the present disclosure are illustrated below, the present invention may be implemented using any number of techniques, whether currently known or in existence. The present disclosure should in no way be limited to the illustrative implementations, and techniques illustrated below, but may be modified within the scope of the appended claims along with their full scope of equivalents.

The terminology and structure employed herein is for describing, teaching and illuminating some embodiments and their specific features and elements and does not limit, restrict or reduce the scope of the claims or their equivalents.

Reference throughout this specification to "an aspect", "another aspect" or similar language means that a particular feature, structure, or characteristic described in connection with the embodiment is included in at least one embodiment of the present invention. Thus, appearances of the phrase "in an embodiment", "in another embodiment" and similar language throughout this specification may, but do not necessarily, all refer to the same embodiment.

Unless otherwise defined, all technical and scientific terms used herein have the same meaning as commonly understood by one of ordinary skilled in the art to which this invention belongs. The system, methods, and examples provided herein are illustrative only and not intended to be limiting. Embodiments of the present invention will be described below in detail with reference to the accompanying drawings.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

Figure 3:
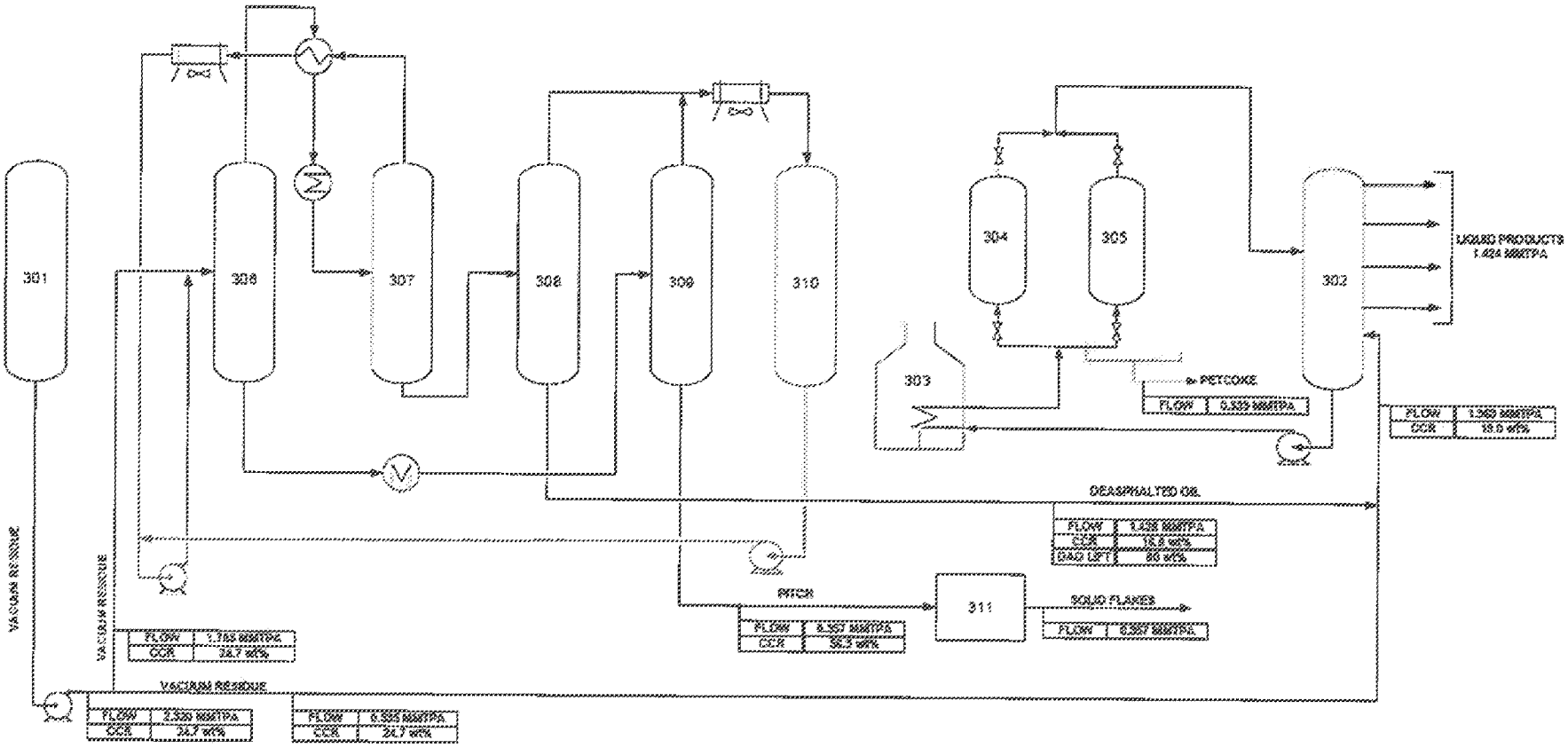
FIG. 3 present process scheme using ROSE technology.
Figure 4:
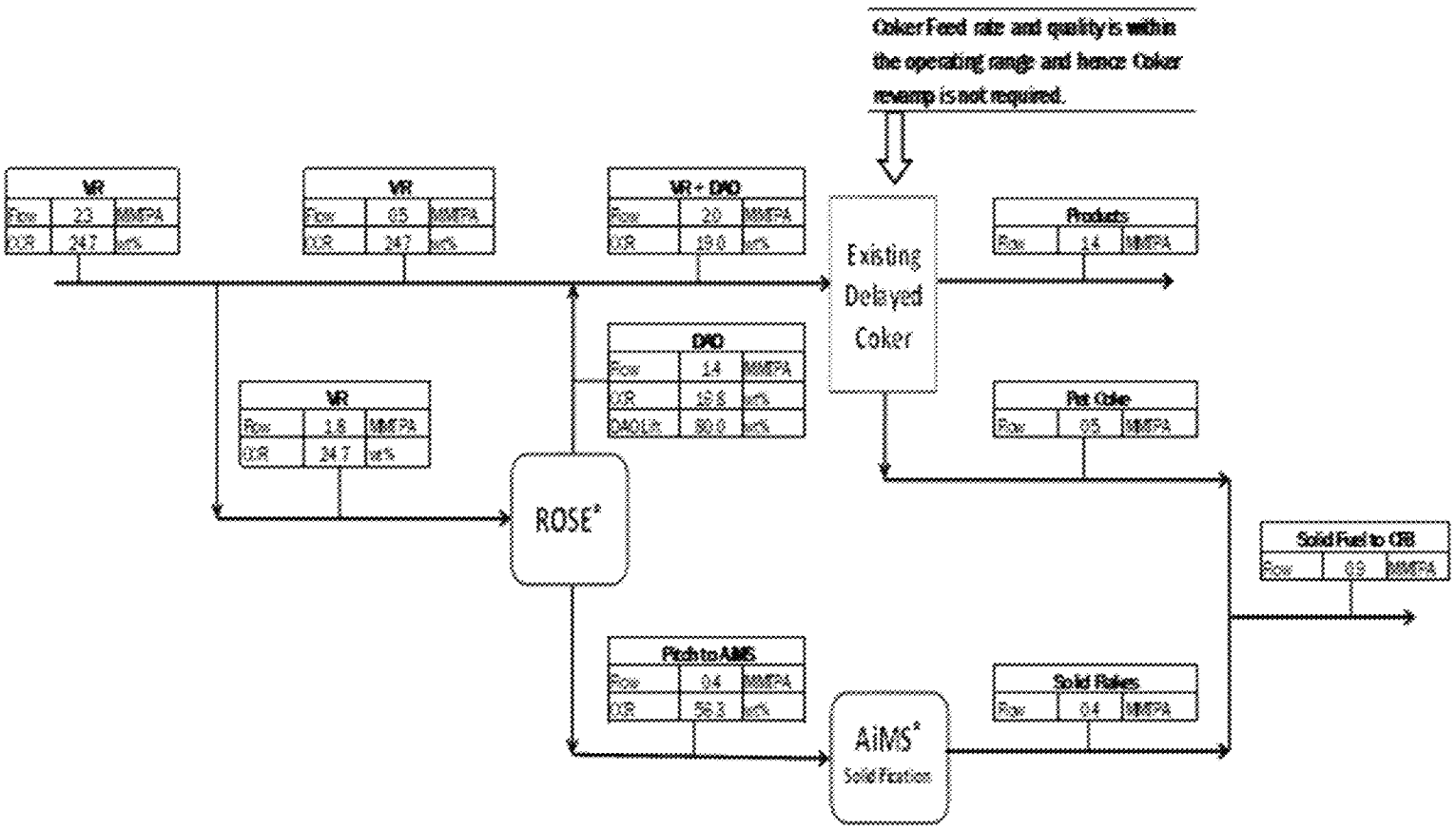
FIG. 4 illustrates an analysis of ROSE Scheme (simplified block flow diagram of FIG. 3).

In the present invention, VR bottoms or a portion of it routed to DCU through ROSE unit as shown in FIGS. 3 and 4, the said process comprises introducing the vacuum residuum bottoms to solvent containing ROSE unit, predominantly a paraffinic stream containing a de-asphalted oil and the solvent; bottoms of ROSE having pitch stream containing asphaltic fraction, which is processed or handled by using KBR licensed solidification process (AiMS). The flakes thus produced from AiMS has similar properties as Petcoke and it is used as substitute of Petcoke in CFBC boiler and in Cement industry. The de-asphalted oil is routed to Coker unit which is within the hydraulic and quality limits of the existing Coker unit. Passing the de-asphalted stream to a DAO stripper to obtain a DAO stream and the residual solvent; heating the DAO stream in a furnace to a coking temperature to obtain a hot stream; transferring the hot de-asphalted stream to one of a plurality of coke drums where it undergoes thermal cracking reaction to obtain hydrocarbon vapors and coke. The hydrocarbon vapors from the coke drums in Coker unit are routed to fractionator column to obtain product fraction.

The feed is selected from vacuum residue, atmospheric residue, cracked vacuum residue from resid Hydrocracker, Wax Oil (Slop Oil) or blend of hydrocarbons, hydrocarbon vapors from Coker furnace is de-asphalted oil and the product fraction from Coker unit is offgas selected from the group consisting of LPG, naphtha, Kerosene, Light Coker gas oil, Heavy Coker gas oil and Coker fuel oil and Pet Coke.

Solvent de-asphalting (SDA) is a process that separates heavy hydrocarbon oil into two phases, an asphalt phase, which contains substances of relatively low hydrogen to carbon ratio often called asphaltene type materials and a de-asphalted oil phase, which contains paraffinic type material substances of relatively high hydrogen to carbon ratio often called De-asphalted Oil (DAO). Hydrocarbons have affinity towards like hydrocarbons, The C3 to C6 paraffinic solvents used have high affinity towards paraffinic material present in vacuum residue.

Figure 5:
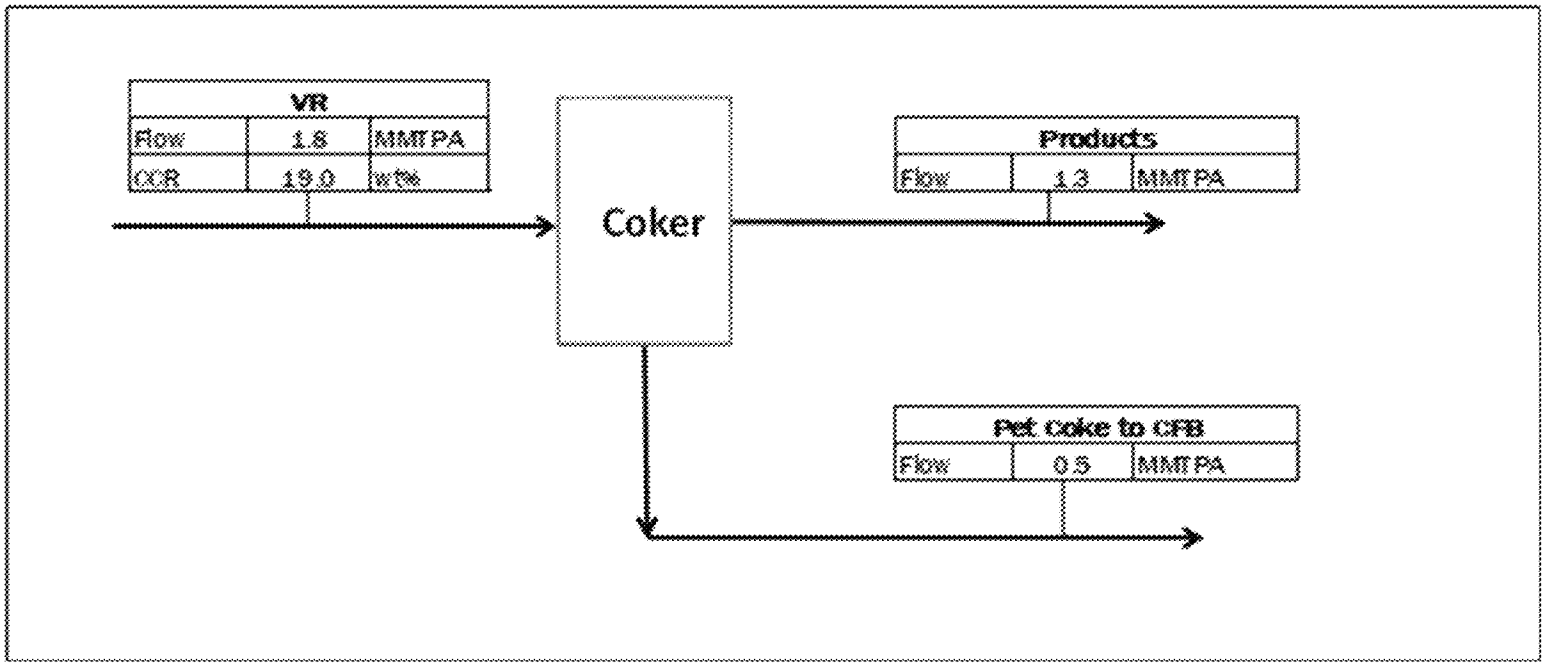
FIG. 5 illustrates an Existing Delayed Coker Unit.
Figure 6:
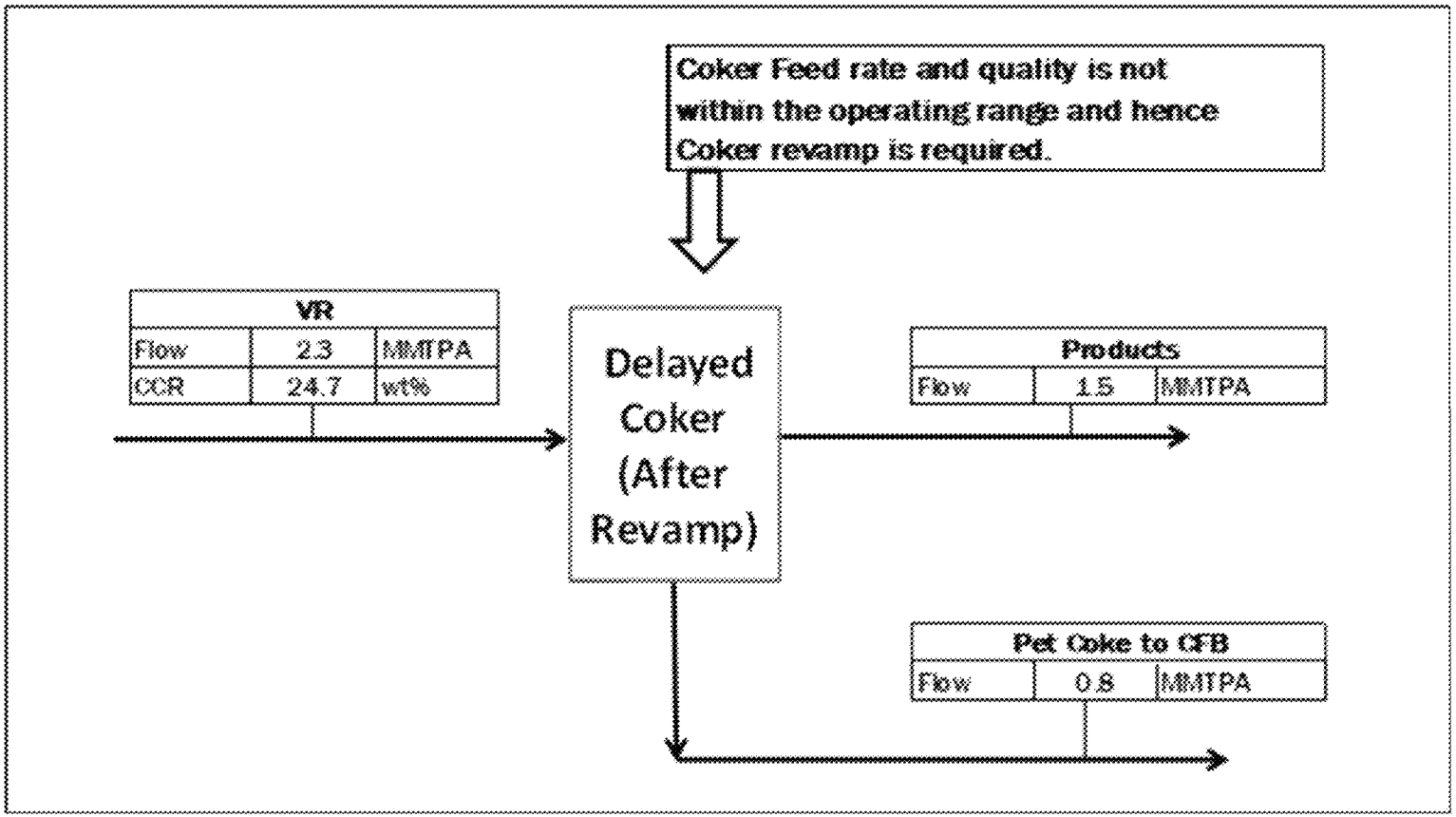
FIG. 6 illustrates a Coker Operation for higher feed rate high CCR requiring revamp (Base Case).

The scheme considers an existing DCU (Coker) with nominal design capacity of 1.8 MMTPA for the processing of VR feed containing 19% wt CCR as shown in FIG. 5. As a normal design practice it has been assumed that 10% hydraulic margin is considered for the design of Coker unit and it is still available to utilize. The refinery has two folds plans—(1) to process heavier crude oil (2) with an increase in the crude processing capacity such that there is an increase of 30% in VR rate. The new VR feed has CCR 24.7 wt % as shown in FIG. 6. Such increase in capacity and high CCR goes beyond the design limits of the Coker unit and requires expensive modifications. The high CCR has direct impact on Coker furnace run length and requires significant modifications in furnace, coke drums and other associated equipment.

TABLE 1

| Design Information of Existing Coker | |
|---|---|
| Existing DCU | |
| Operating Capacity, MMTPA | 1.8 |
| Design CCR, wt % | 19.0 |
| Overcapacity Available | 10% |
| Revamp Conditions | |
| Increase in VR feed Rate | 30% |
| CCR in Vacuum Residue, wt % | 24.7 |

The ROSE unit in combination with existing Coker eliminates the need of expensive Coker revamp as shown in FIGS. 3 and 4. Build the ROSE unit independently and integrated with the existing system in short shutdown period whereas the Coker revamp will require longer plant shut down to implement changes leading to production loss. Additionally, the major advantage of present invention KBR scheme is the cost saving in terms of investment required i.e. low cost SDA vs high investment Coker revamp.

The ROSE unit in this case is a high lift DAO design which acts as a treater for the vacuum residue stream and helps in rejecting CCR in Pitch which is solidified and used as substitute of Petcoke (solid fuel). The DAO thus produced has lower CCR than the new feed and also lower than in original VR feedstock. A small fraction of high CCR feedstock is added to DAO stream to reach up to the allowable limit of CCR (i.e. 19%). The resultant feed rate to Coker in this case is little higher than original feed rate but still within the hydraulic design limits after considering the 10% overdesign available. By the implementation of this scheme since CCR and the feed rate both remains within the design limits, no expensive revamp of Coker is needed.

BEST MODE OF THE INVENTION

An embodiment of the invention includes a process combining KBR licensed ROSE unit with the existing Coker unit so that existing Coker does not require any revamp by processing de-asphalted oil produced from ROSE unit in a Coker unit.

The present invention is explained with the following example.

Figure 1:
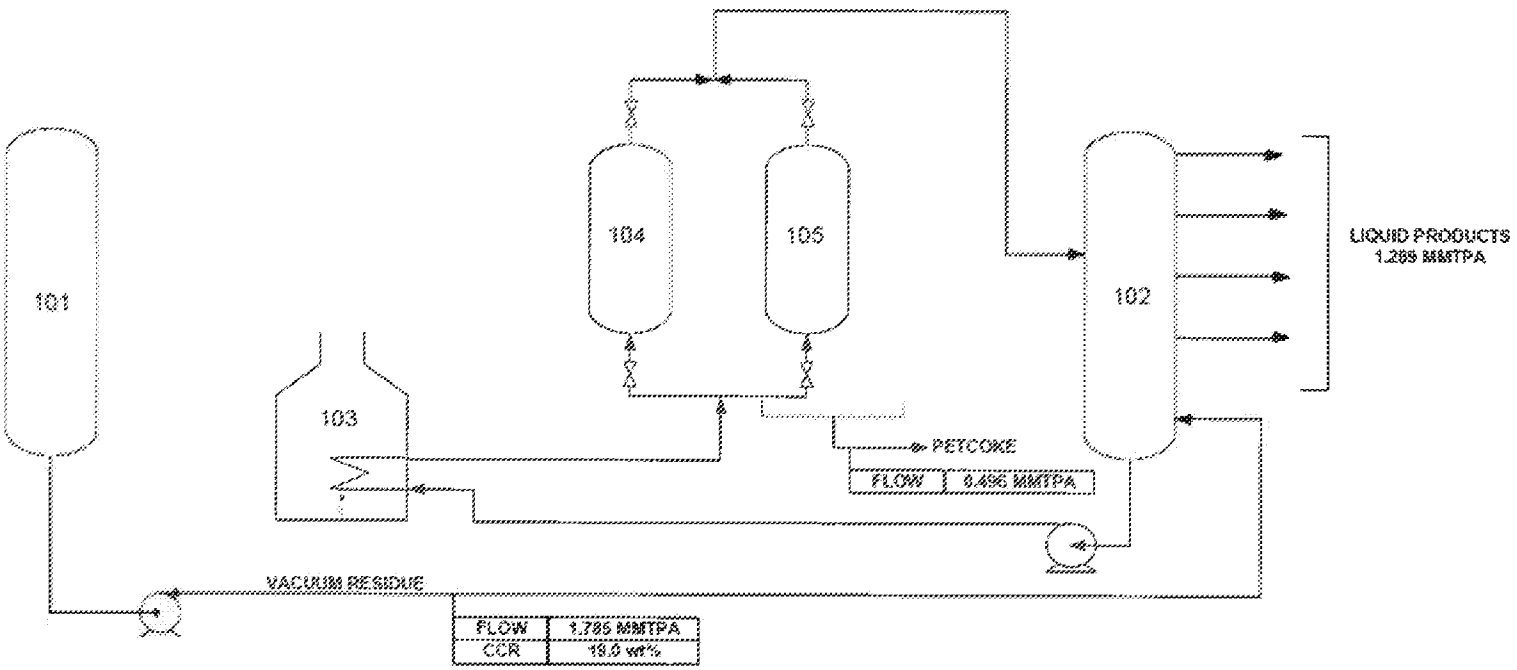
FIG. 1 operation of existing Coker unit.

1. Existing delayed Coker, which was designed to process vacuum residue having a CCR of 19 wt % with a nominal capacity of 1.8 MMTPA as shown in Figure-1. It is assumed that additional 10% hydraulic design capacity is available to utilize.

2. Currently crude processing capacity has been increased such that there is an increase of 30% vacuum residue and crude slate has been changed such that vacuum residue CCR is increased from 19.0 wt % to 24.7 wt %.

Figure 2:
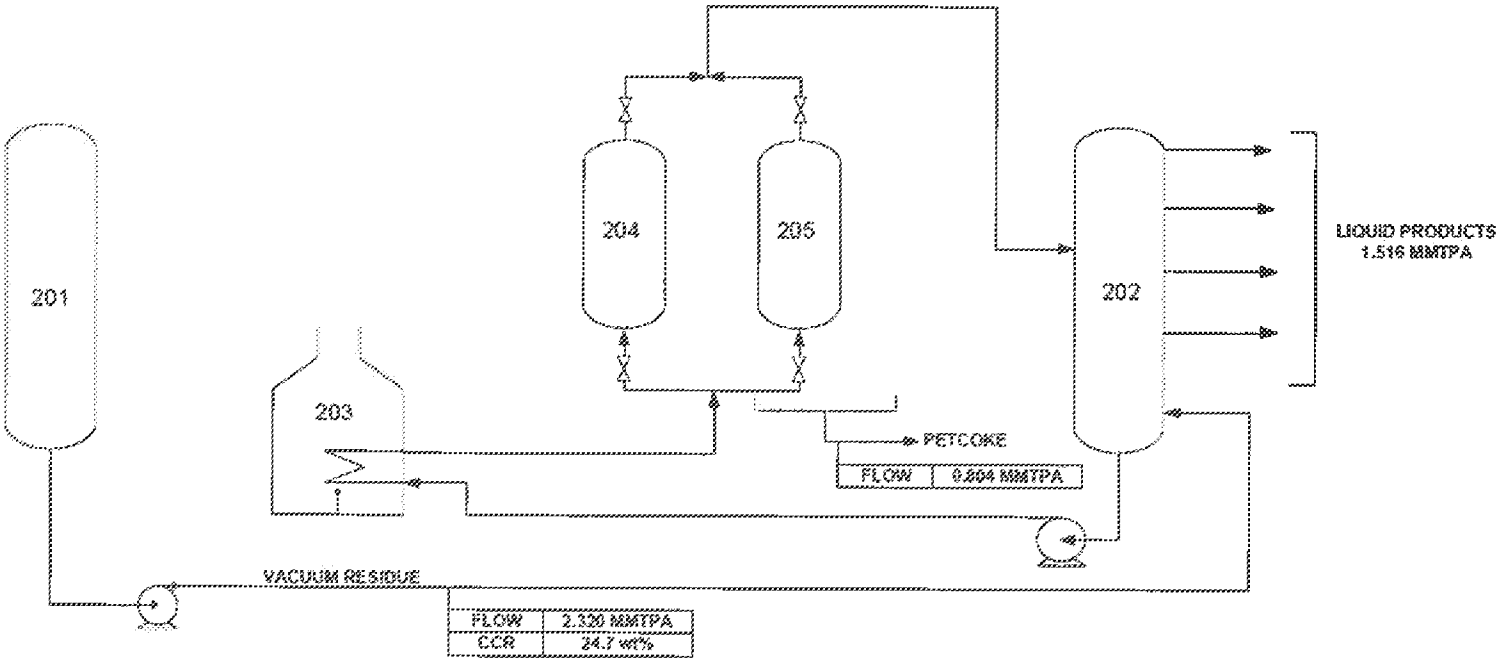
FIG. 2 operation of existing Coker for new feed rate and CCR.

3. Existing Coker cannot process the new vacuum residue feed as CCR and feed rate exceeds the design range, and hence revamp is required with expensive modifications and longer implementation time. The configuration with revamp requirement is shown in Figure-2.

4. KBR licensed ROSE unit combined with the existing Coker is proposed in the present invention to eliminate the need for expensive revamp. The line-up of proposed scheme is detailed below and is shown in Figure-3.

2.3 MMTPA of vacuum residue having 24.7 wt % of CCR is available to process. A part (1.8 MMTPA) of vacuum residue is routed to ROSE unit instead of directly routing to Coker unit.

Depending on the crude oil being processed, vacuum residue typically contains 15 to 30% asphaltenes. This leaves 70 to 85% of the vacuum residue as potentially recoverable DAO. DAO and asphaltenes will be separated in ROSE SDA unit. ROSE unit uses light hydrocarbon solvent to extract DAO from vacuum residue.

The yield of DAO from the ROSE unit is about 80 wt % with DAO CCR of 16.8 wt %.

The DAO from ROSE unit is routed to existing Coker by mixing with rest of the available vacuum residue of 0.5 MMTPA. The combined flow at the Coker inlet is 2.0 MMTPA and the CCR in combined feed is 19 wt %.

The combined feed to Coker with this configuration is within the design limits of existing Coker; hence, no expensive revamp is required as shown in FIG. 4.

With the proposed configuration, the ROSE unit can be built independently and can be integrated with the existing system in short shutdown period whereas the Coker revamp will require longer plant shut down to implement changes leading to production loss.

The pitch produced from ROSE unit can be solidified in the form of flakes (solid fuel) in KBR licensed solidification process (AiMS). The flakes thus produced has similar properties as Petcoke, can be used as substitute of Petcoke in CFBC boiler, and can be used in Cement industry.

The words "comprising" and "comprises" as used throughout the claims, are to be interpreted to mean "including but not limited to" and "includes but not limited to", respectively.

As used herein, the word "substantially" shall mean "being largely but not wholly that which is specified."

As used herein, the singular forms "a," "an," and "the" are intended to include the plural forms as well, unless the context clearly indicates otherwise.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

The invention claimed is:

1. A process for producing rich feedstock to delayed Coker unit having a set design limits from different crude slate, the process comprising:

introducing a feedstock to crude distillation unit;

passing the bottoms of the crude distillation unit to vacuum distillation unit for further extraction of product fraction, wherein the bottoms of the vacuum distillation unit is routed for further extraction as feed at a flow rate and with a CCR content that exceed the design limits of the Coker unit;

contacting at least a portion of the feed with solvent in a de-asphalting unit to obtain a pitch stream containing asphaltenic fraction and predominantly a paraffinic stream containing a de-asphalted oil and the solvent;

passing the de-asphalted oil stream to a DAO stripper in SDA unit to obtain a DAO stream and the residual solvent;

mixing the DAO stream with a portion of the bottoms of the vacuum distillation unit to produce a mixed stream having a flow rate and a CCR content within the design limits of the Coker unit;

heating the mixed stream in a furnace to a coking temperature to obtain a hot stream;

transferring the hot stream to one of a plurality of coke drums where it undergoes thermal cracking reaction to obtain hydrocarbon vapors and coke; and passing the hydrocarbon vapors produced from coking of de-asphalted oil to the fractionator column to obtain various product fraction.

2. The process as claimed in claim 1, wherein the solvent is selected from the group comprising of hydrocarbons having 3 to 6 carbon atoms and mixtures thereof.

3. The process as claimed in claim 1, wherein the feed is selected from vacuum residue, atmospheric residue, cracked vacuum residue from resid Hydrocrackers, Wax Oil (Slop Oil) or blend of hydrocarbons.

4. The process as claimed in claim 1, wherein the product fraction from Coker unit is offgas selected from the group consisting of LPG, naphtha, Kerosene, Light Coker gas oil, Heavy Coker gas oil and Coker fuel oil and Pet Coke.

5. The process as claimed in claim 1, wherein the hydrocarbon vapors from Coker furnace is de-asphalted oil.

* * * * *